US005458419A

United States Patent [19]

Trepte et al.

[11] Patent Number: 5,458,419

[45] Date of Patent: Oct. 17, 1995

[54] FLEXIBLE CONTAINER FOR BULK MATERIAL

[75] Inventors: Peter Trepte, Emsdetten; Josef Alteepping, Ochtrup; Günther Lüttgens, Odenthal, all of Germany

[73] Assignee: EMPAC Verpackungs GmbH & Co., Emsdetten, Germany

[21] Appl. No.: 17,230

[22] PCT Filed: Jul. 2, 1992

[86] PCT No.: PCT/EP92/01491

§ 371 Date: Apr. 21, 1993

§ 102(e) Date: Apr. 21, 1993

[87] PCT Pub. No.: WO93/01110

PCT Pub. Date: Jan. 31, 1993

[30] Foreign Application Priority Data

Jul. 2, 1991 [DE] Germany ..... 9108091 U

[51] Int. Cl.[6] ..... B65D 30/06; B65D 33/14

[52] U.S. Cl. ..... 383/22; 383/41; 383/67; 383/117

[58] Field of Search ..... 383/22, 24, 41, 383/67, 117

[56] References Cited

U.S. PATENT DOCUMENTS 4,211,266 7/1980 Massey ..... 383/22
4,300,608 11/1981 Cuthbertson ..... 383/22
5,092,683 3/1992 Wurr ..... 383/117
5,244,281 9/1993 Williamson et al. ..... 383/117

FOREIGN PATENT DOCUMENTS 0340622 11/1989 European Pat. Off. ..... 383/117

*Primary Examiner*—Stephen P. Garbe
*Attorney, Agent, or Firm*—Jordan and Hamburg

[57] ABSTRACT

A flexible bulk goods container (1) with a container body (2), which can form a bulk goods accommodating space, is filled and emptied over a connector/outlet arrangement (3, 4), can be lifted by means of carrying loops (5) or the like and is preferably made from a coated basic weave, particularly of polypropylene that is electrically conductive due to integrated conductors. As a basic weave, a ribbon-like fabric is provided, in which, at a distances of not more than 30 mm in the warp or in the filling, a basic weave ribbon (6, 7) is replaced by an electrically conductive ribbon (8) of a plastic film material forming the electrical conductor, with a transverse extent corresponding essentially to that of the basic weave ribbon (6, 7) is substituted and/or assigned to the basic weave ribbons (6,7) in an essentially congruent arrangement.

19 Claims, 4 Drawing Sheets

FLEXIBLE CONTAINER FOR BULK MATERIAL

BACKGROUND OF THE INVENTION

The invention relates to a flexible bulk goods container.

Flexible bulk goods containers are used for packaging, transporting, handling and stockpiling different bulk goods materials in amounts of, in each case, 500 to 2,000 kg. However, they are also used in area, in which there are increased risks of explosion. These risks of explosion can be attributed, for example, to the risks associated with filling a bulk goods container (FIBC) with material capable of undergoing dust explosions. Moreover, when emptying the FIBC, the risk of gas explosions can arise in addition to the risk of dust explosions, if the material is emptied into a container, which already contains a flammable liquid. In all areas of use, in which there is the risk of explosion due to gases, vapors or dust, electrostatically conductive bulk goods containers must be used.

In the design of electrostatically conductive bulk goods containers, consideration must therefore be given to the risks of a brush discharge in the case of gases and vapors with a low minimum ignition energy, as well as to the risks of a sliding brush discharge, which is attributed particularly to charge double layers. In addition, electrostatic charging processes, such as those caused by the filling and emptying process, must of course, be taken into consideration. However, it is also necessary to make certain that the bulk goods container has strength properties, which ensure bulk goods up to 2 tons can be held and that there is sufficient tightness to prevent the exit of dust through the fabric.

Bulk good containers of the initially named type are known, for which there is basic weave, which are coated on the inside and in which electrically conductive metal conductors in the form of metallic threads are integrated, is used. It is a disadvantage of these bulk goods containers that they are not produced from a homogeneous material (polypropylene) and that they therefore cannot be recycled. In addition, the danger exists that the metallic conductor will react chemically with the bulk goods.

The European publication 0 413 886 discloses a bulk goods container, for which a basic weave of synthetic yarns and electrically conductive synthetic yarns, which are woven into the basic weave, are used. These electrically conductive synthetic yarns preferably are monofilaments, in which conductive carbon is dispersed, as it is in those yarns basically known for the fabrics of the British patent 2,101, 559, as well as the German patent 25 24 640.

It is an important disadvantage of such a bulk goods container that, when yarns are used, be they in the shape of fibers, monofilaments or multifilaments, relatively small surface areas are available for discharging the electrical potential. If a particular surface size is to be provided for adequate discharging properties, the thread is exceptionally stiff and not sufficiently flexible, so that the strength properties in this respect are adversely affected at those places where the thread is woven into this fabric. Because of the different diameters of basic weave threads and the electrically conductive threads, defects in the finished fabric cannot be avoided and have a further adverse effect on the strength properties of the container. Moreover, the production of this known fabric is very expensive, because basic weave threads and electrically conductive threads cannot be processed with the same warp beam.

SUMMARY OF THE INVENTION

It is an object of the present invention to provide an electrostatically conductive bulk goods container, preferably in a coated form, which at the same time provides safety against sliding brush discharges, which are potential sources of ignition for combustible dusts, as well as for gases and vapors, as well as against brush discharges, which are potential sources for ignition for gases and vapors. Moreover, the container shall also have adequate strength properties, even in the region of the integrated conductors. Furthermore, it shall be possible to provide the bulk goods container with little effort with inexpensive electrical conductors.

For the inventive bulk goods container, either the narrow ribbons of the basic weave are replaced by electrically conductive ribbons in the warp or in the weft, or a ribbon of the basic weave is additionally provided with an electrically conductive ribbon. The basic weave, therefore, does not develop any weaknesses whatsoever due to the electrically conductive ribbon, since the electrically conductive ribbon is fitted exactly into the structure of the basic weave. A conductive surface, which is significantly larger even than one composed of threads is created by the ribbon towards the space accommodating the bulk goods as well as towards the outside so that a thin, highly elastic conductor, with a very large discharging surface is used. Due to the interval of at most 30 mm, the conductive ribbons can comply with the required discharging resistance for such bulk goods containers and also avoid dangerous levels of electrostatic charging. In the simplest embodiment, the electrically conductive ribbons, which are provided at an interval of at most 30 mm in the basic weave, are connected in each bulk goods container region, that is, in each side wall, the bottom surface, etc., by at least one electrically conductive ribbon running orthogonally to the basic weave. The electrically conductive tapes or ribbons have a charge-eliminating resistance of less than $10^8$ ohm.

A flexible bulk goods container, made from fabric ribbons, is inherently not dustproof. In order to prevent passage of dust, the fabric is provided preferably on the inner side of the container with a coating of polypropylene. However, this coating prevents discharging of the charged bulk goods to the grounded ribbon that is capable of dissipating electrostatic charges. Moreover, charge potentials can be built up at the coating which are so high, that sliding brush discharges can occur, which ignite not only gases and vapors, but also dust.

Sliding brush discharges are reliably avoided if the breakdown voltage of the coating is less than 4 KV. This is attained by an appropriately thin coating over the conductive ribbons, for example, by a vacuum coating.

In the event that the breakdown voltage over the ribbons is less than 4 KV, sliding brush discharges admittedly are reliably avoided. However, the danger of the appearance of brush discharges, which are capable of igniting gases and vapors, continues to exist.

Discharging the charged bulk goods is made possible by micropores in the coating in the region of the conductive ribbons. Pores, the diameter of which is substantially less than the diameter of the smallest dust particle that is to be expected, are achieved by suitable methods (such as a corona treatment). By these means, brush discharges in coated containers at the conductive ribbons, which are disposed at an interval of 30 mm, are reliably avoided.

With this, such a coated container is conductive on the inside and on the outside within the meaning of the guidelines "Static Electricity" of the BG chemistry.

While being filled and emptied, the bulk goods container can be grounded by means of electrically conductive lifting loops. The electrically conductive loops, which are already known from bulk goods containers that can be discharged by means of modified synthetic resins, at the same time have the task of connecting together electrically the components of the container body, shown in FIG. 1.

The electrically conductive ribbons are made from a plastic film material, such as polypropylene preferably of cut film sheet sections, which can be converted to an electrically conductive synthetic material by the addition of carbon.

BRIEF DESCRIPTION OF THE DRAWINGS

For the further explanation, reference is made to the following description and the drawing, in which.

DESCRIPTION OF THE PREFERRED EMBODIMENTS

Figure 1:
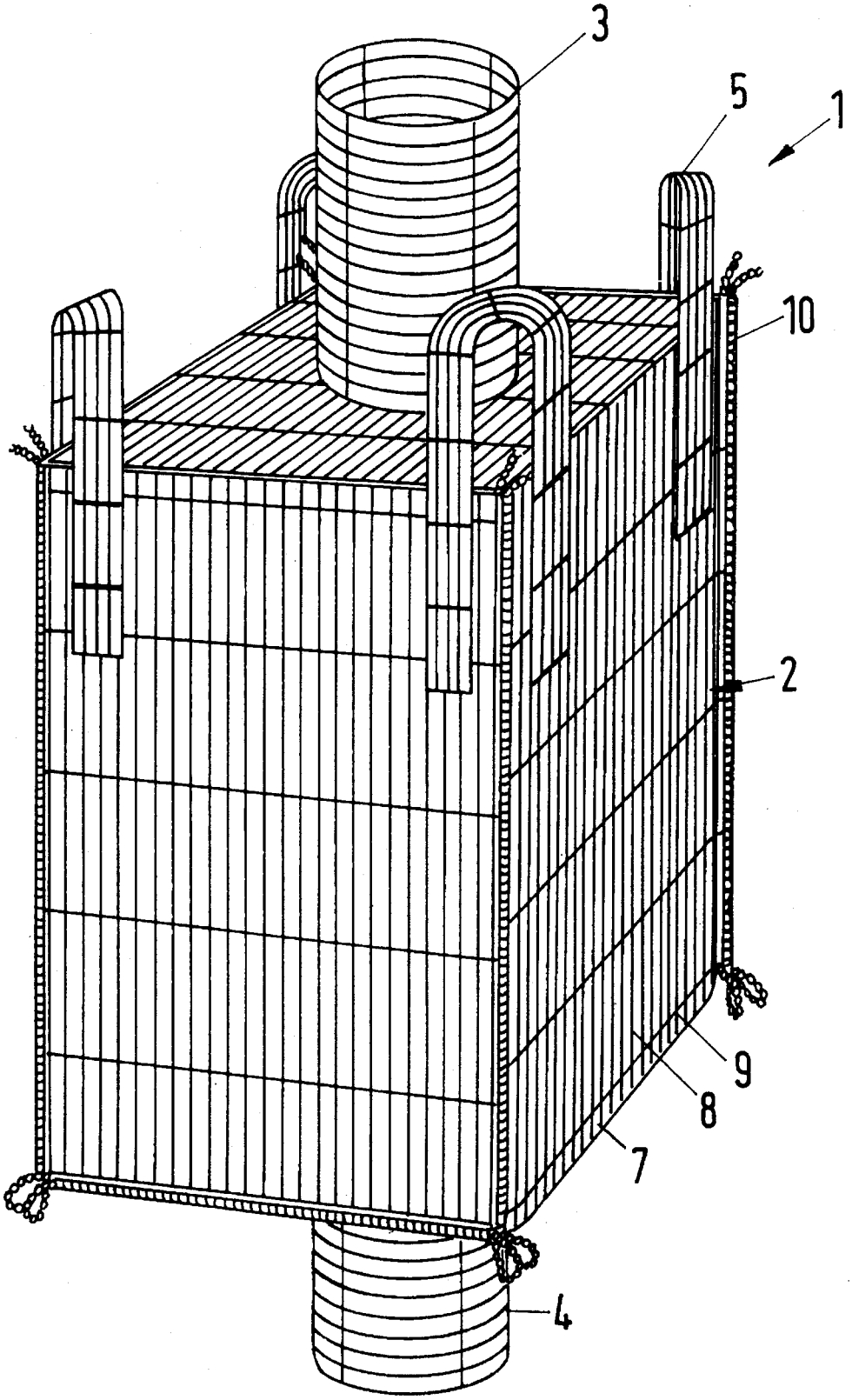
FIG. 1 shows a diagrammatic, perspective representation of an embodiment of an inventive bulk goods container that is rectangular in cross section.

The bulk goods container, labeled generally with I in the drawing, has in the embodiment of FIG. 1 a container body 2, which is rectangular in cross section and has four sides as well as a bottom and a cover area. The container is filled through a filling connector or spout 3 and emptied through an output or emptying spout 4. The bulk goods container can be lifted and handled by means of the carrying loops 5, which are sewn to the side walls. In the illustrated embodiment of FIG. 1, the bulk goods container is made from of a fabric of, preferably, polypropylene.

Figure 4:
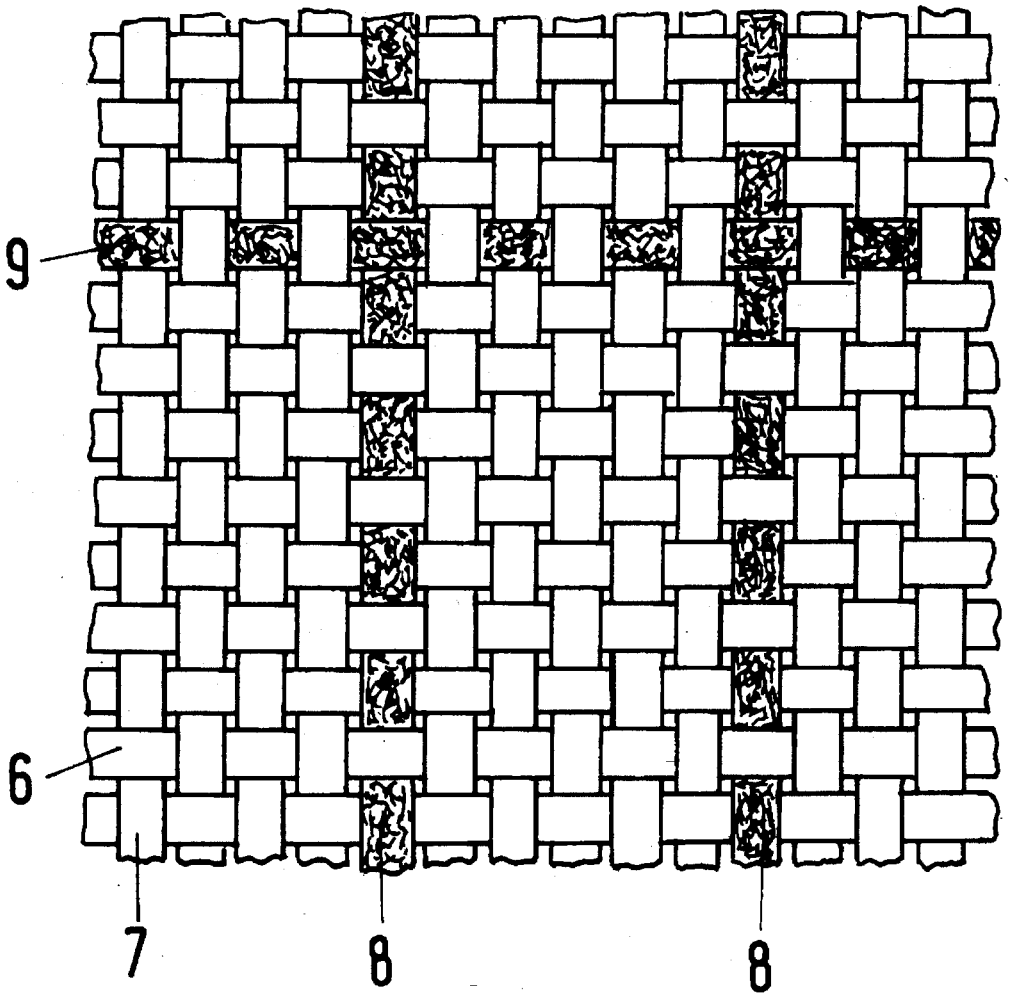
FIG. 4 shows a section of a plan view of the basic weave.

The container body 2 has a basic weave of warp ribbons or tapes and weft ribbons or tapes (FIG. 4). At intervals "a" of at most 30 cm, electrically conductive ribbons 8 are provided in the weft instead of the normal weft ribbon 7 in the embodiment illustrated. This electrically conductive ribbon 8 therefore replaces this weft ribbon without defects in the fabric. Crossing over the electrically conductive ribbons 8, which are provided at an interval of at most 30 mm, are warp ribbons 9, which are of electrically conductive construction and are provided in each container region. The electrically conductive ribbons are therefore connected with one another. The contacting can likewise be ensured by means of electrically conductive sewing thread 10 in the bottom and side areas and at other places that have to be sewn. The carrying loops are analogously made conductive by electrically conductive ribbons, so that the bulk goods container as a whole can be grounded over the carrying loops. In the embodiment of FIG. 1, the filling connector and the outlet likewise are made from a flat woven fabric and, with that, are also made electrically conductive by electrically conductive ribbons provided at intervals of 30 mm.

Figure 2:
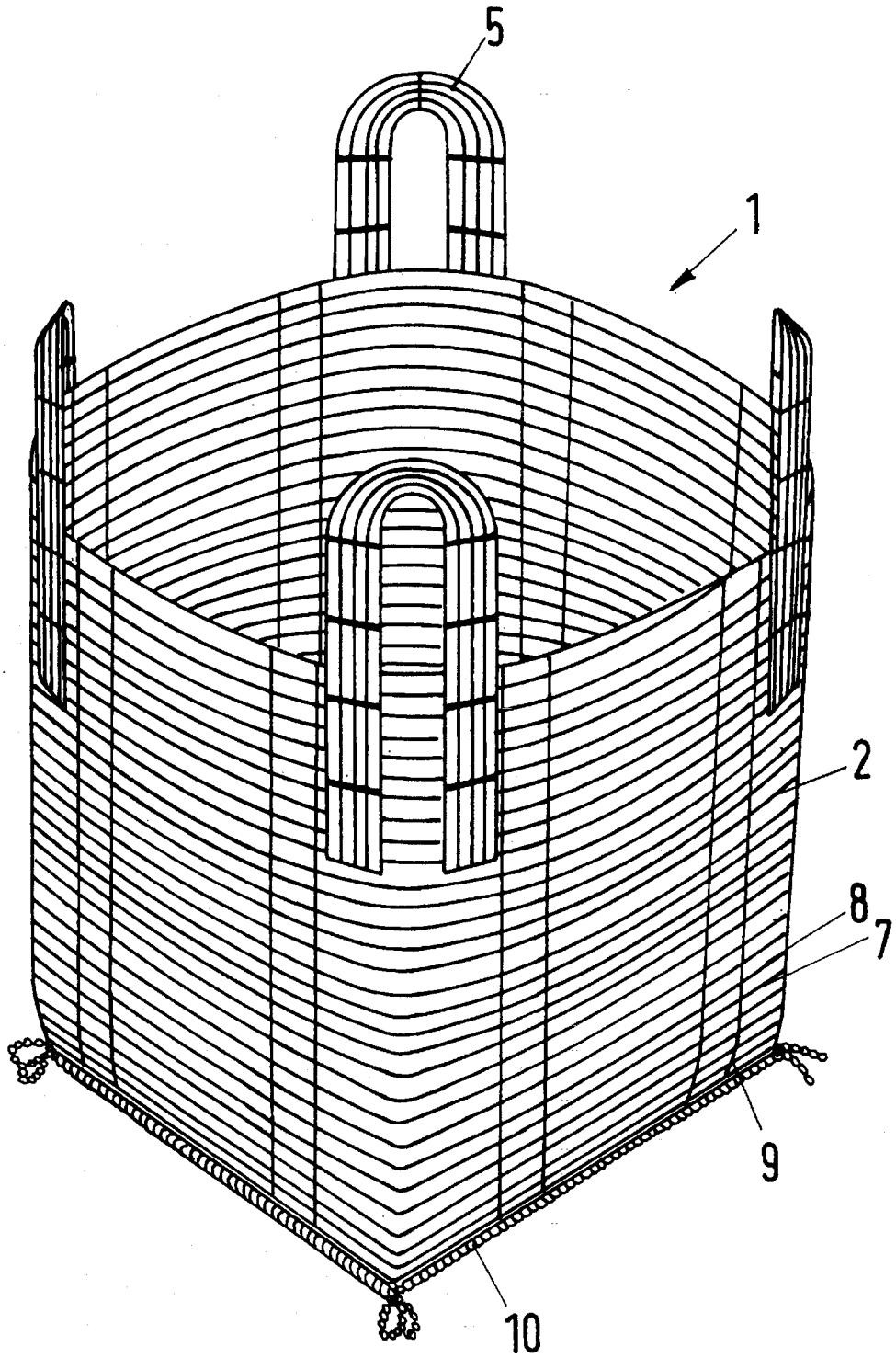
FIG. 2 shows a diagrammatic, perspective representation of a further embodiment of an inventive bulk goods container with a container body of a circular fabric.

The bulk goods container shown in FIG. 2 is constructed as a large-volume carrying bag, which is made from a circular fabric. Instead of a normal ribbon, an endless, electrically conductive ribbon is integrated in the basic weave, a maximum distance dimension between electrically conductive ribbons of 30 mm being realized once again.

Figure 3:
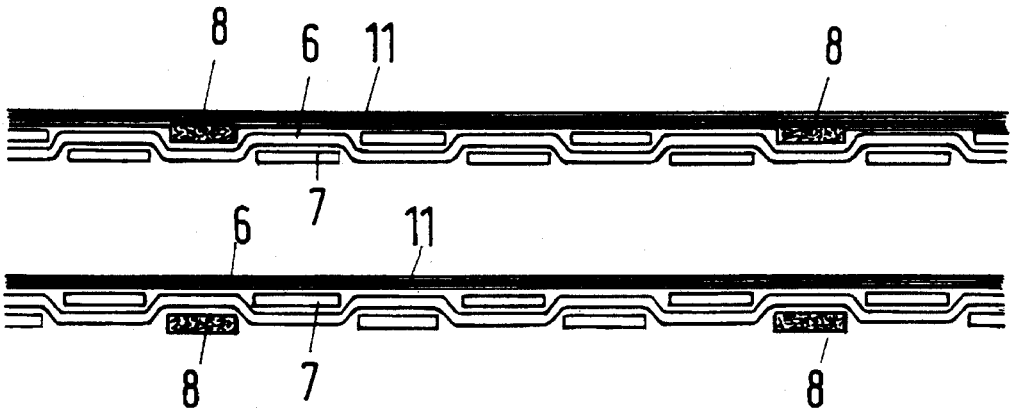
FIG. 3 shows an enlarged section of two cross sections through the basic weave that are provided with electrical conductive ribbons.
Figure 5:
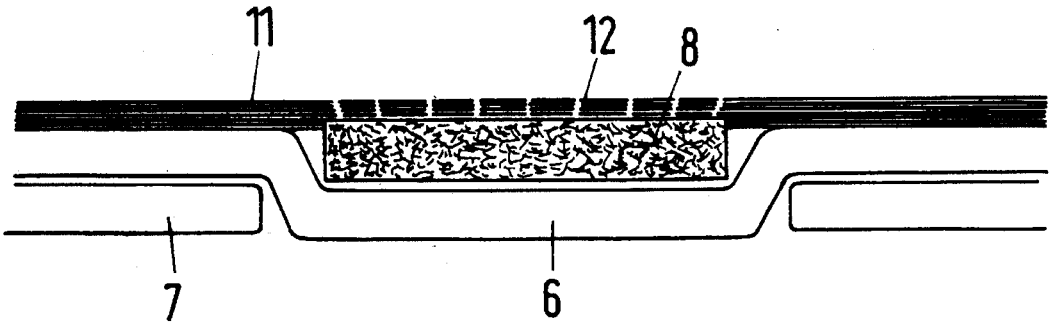
FIG. 5 shows a section of a representation similar to that of FIG. 3, with a coating that is provided with micropores (enlarged).

FIG. 3 illustrates in two cross sections the manner in which the electrically conductive ribbon is integrated. As shown in blackened form, ribbon 8, which is provided in the weft, is woven in instead of a normal filling ribbon. Alternatively, particularly for reasons of strength, an electrically conductive ribbon 8 can also run next to the normal weft ribbon 7. From a production point of view, this can also be done relatively simply and inexpensively with only one warp beam. On the inside, the container is provided with the coating 11, which is indicated in FIGS. 3 and 5. This coating 11 is preferably deposited as a vacuum coating. For the reasons given, this coating 11 can also be provided with micropores 12 at least in the region of the ribbons (FIG. 5), as a result of which the bulk goods container becomes capable of dissipating electrostatic charges on the inside and on the outside.

We claim:

1. A flexible bulk goods container comprising:

a container body defining an accommodating space for holding bulk goods, a filling spout for filling and an emptying spout for emptying the bulk goods from said accommodating space, at least one carrying loop for lifting said container body, and said container body, said filling spout and said emptying spout being formed from a basic weave having a coating thereon, said basic weave including:

a tape fabric formed from warp tapes extending in a warp direction and weft tapes extending in a weft direction, and an electrical conductor formed by parallel, electrically conductive tapes of a plastic film material arranged at positions of at least one of:

said warp tapes and said weft tapes, said electrically conductive tapes being spaced apart by a distance of not more than 30 mm in the respective one of said warp direction and said weft direction, and said electrically conductive tapes being woven into said tape-like fabric and having a width corresponding essentially to respective ones of said warp and weft tapes, and said coating is perforated in regions of said electrically conductive tapes.

2. The flexible bulk goods container of claim 1, wherein said electrically conductive tapes are substituted for respective ones of said warp tapes and said weft tapes.

3. The flexible bulk goods container of claim 1, wherein said electrically conductive tapes are essentially congruent with respective ones of said warp tapes and weft tapes.

4. A flexible bulk goods container of claim 1, wherein said coating is along an inner surface of said basic weave and is made from polypropylene.

5. The flexible bulk goods container of claim 1, wherein said electrically conductive tapes have a charge-eliminating resistance of less than $10^8$ ohm.

6. The flexible bulk goods container of claim 1, wherein at least one of:

said container body, said filling spout and said emptying spout have a basic weave of a tape-type circular fabric, and said electrical conductor includes an endless, electrically conductive weft tape and at least one electrically conductive warp tape which crosses said electrically conductive weft tape.

7. The flexible bulk goods container of claim 1, wherein said at least one carrying loop are electrically conductive, and electrically conductive tapes are connected with said at least one electrically conductive carrying loop for grounding said container.

8. The flexible bulk goods container of claim 1, further including electrically conductive sewing thread for electrically connecting together said electrically conductive tapes.

9. The flexible bulk goods container of claim 1, wherein said at least one carrying loop are electrically conductive, and the at least one electrically conductive carrying loop contact several electrically conductive tapes.

10. The flexible bulk goods container comprising:

a container body defining an accommodating space for holding bulk goods, a filling spout for filling and an emptying spout for emptying the bulk goods from said accommodating space, at least one carrying loop for lifting said container body, and said container body, said filling spout and said emptying spout being formed from a basic weave having a coating thereon, said basic weave including:

a tape fabric formed from warp tapes extending in a warp direction and weft tapes extending in a weft direction, and an electrical conductor formed by parallel, electrically conductive tapes of a plastic film material arranged at positions of at least one of:

said warp tapes and said weft tapes, said electrically conductive tapes being spaced apart by a distance of not more than 30 mm in the respective one of said warp direction and said weft direction, and said electrically conductive tapes being woven into said tape-like fabric and having a width corresponding essentially to respective ones of said warp and weft tapes, and said coating has a breakdown voltage of less than 4 KV.

11. The flexible bulk goods container of claim 10, wherein said electrically conductive tapes are substituted for respective ones of said warp tapes and said weft tapes.

12. The flexible bulk goods container of claim 10, wherein said electrically conductive tapes are essentially congruent with respective ones of said warp tapes and weft tapes.

13. The flexible bulk goods container of claim 10, wherein said coating is along an inner surface of said basic weave and is made from polypropylene.

14. The flexible bulk goods container of claim 10, wherein said electrically conductive tapes have a charge-eliminating resistance of less than $10^8$ ohm.

15. The flexible bulk goods container of claim 10, wherein at least one of:

said container body, said filling spout and said emptying spout have a basic weave of a tape-type circular fabric, and said electrical conductor includes an endless, electrically conductive weft tape and at least one electrically conductive warp tape which crosses said electrically conductive weft tape.

16. The flexible bulk goods container of claim 10, wherein said at least one carrying loop are electrically conductive, and electrically conductive tapes are connected with said at least one electrically conductive carrying loop for grounding said container.

17. The flexible bulk goods container of claim 10, further including electrically conductive sewing thread for electrically connecting together said electrically conductive tapes.

18. The flexible bulk goods container of claim 10, wherein said at least one carrying loop are electrically conductive, and the at least one electrically conductive carrying loop contact several electrically conductive tapes.

19. The flexible bulk goods container of claim 10, wherein edges of the container body and other parts of the bulk goods container are turned, through 180°, so that uncoated sides of the fabric of parts to be connected can be connected to one another electrically at the turned edges.

* * * * *